United States Patent [19]

Cawley

[11] Patent Number: 4,579,064

[45] Date of Patent: Apr. 1, 1986

[54] TRANSFER WHEEL ASSEMBLY FOR TRANSPORTING DISABLED RAILWAY VEHICLE

[75] Inventor: John W. Cawley, Brooklyn, N.Y.

[73] Assignee: New York City Transit Authority, Brooklyn, N.Y.

[21] Appl. No.: 625,665

[22] Filed: Jun. 28, 1984

[51] Int. Cl.[4] ..... B61F 13/00; B61K 5/02

[52] U.S. Cl. ..... 105/215 R; 105/157 R

[58] Field of Search ..... 104/243, 263; 105/159, 105/215 R, 216, 215 C, 157 R; 280/47.13 R, 47.15

[56] References Cited

U.S. PATENT DOCUMENTS

| | | | |
|---|---|---|---|
| 426,474 | 4/1890 | Smalley | 280/47.13 R X |
| 788,460 | 4/1905 | Fields | 105/215 R |
| 1,206,994 | 12/1916 | Craigmile | 105/215 R |
| 2,491,034 | 12/1949 | Couch | 105/215 R X |
| 2,592,307 | 4/1952 | McGowan | 105/216 |
| 3,338,184 | 9/1967 | Fisher | 105/215 C |
| 4,133,269 | 1/1979 | Taylor | 105/215 R X |
| 4,381,713 | 5/1983 | Cripe | 105/215 C |
| 4,505,489 | 3/1985 | Specie | 280/47.13 R |

FOREIGN PATENT DOCUMENTS

| | | | |
|---|---|---|---|
| 0002764 | 2/1847 | France | 105/215 R |

*Primary Examiner*—Randolph A. Reese
*Assistant Examiner*—Scott H. Werny
*Attorney, Agent, or Firm*—Anthony J. Casella; Gerald E. Hespos

[57] ABSTRACT

A transfer wheel assembly is provided for mounting on disabled railway vehicles to enable the disabled vehicle to be safely moved. The transfer wheel assembly includes a pair of transfer wheels for mounting on a pair of rails. Each wheel is rotatably mounted to a support frame. The support frame, in turn, is mountable on the truck of the disabled vehicle. The support frames are connected to one another by a spreader bar which maintains the proper spacing between the support wheels.

9 Claims, 11 Drawing Figures

TRANSFER WHEEL ASSEMBLY FOR TRANSPORTING DISABLED RAILWAY VEHICLE

BACKGROUND OF THE INVENTION

Disabled railway vehicles often can not be repaired at the location where the disability occurs or is first noticed. This is partly because the presence of a disabled vehicle on a track disrupts other train service in or through the area of the disability. Therefore prompt removal of the disabled vehicle is essential to the continued efficient operation of a large portion of the railway system. Additionally, the repair often requires specialized equipment and personnel that cannot readily be transported throughout an entire system to perform repair work. Furthermore, space limitations and safety factors very often preclude on site performance of repair work. For example, in many railway systems a large percentage of the trackage is either in tightly confined tunnels or on elevated structures. In either of these situations, the performance of extensive repair work is not feasible. On site repair work is even less realistic if the repair requires the use of welding or cutting equipment. Specifically steel dust, lubricants and debris often found adjacent to tracks can cause fires with extensive damage to nearby power, communication and signal lines being likely.

A particularly troublesome type of railway vehicle disability is one in which the wheels of the vehicle are rendered completely or partly inoperative. For example, a wheel may become fractured as a result of being subjected to heat or stresses over an extended period of time. In many such instances, one or more of the railway vehicle wheels is shattered into several distinct pieces. A similar disability to the train wheels is attributable to locked pinion gears. The locking of the pinion gear effectively stops the associated wheel or wheels from rotating. This failure may occur several vehicles away from the driver or engineer of the train who will be completely oblivious to the inability of certain wheels to rotate. These non-rotating wheels can be dragged along the track for many miles. This frictional interaction between the non-rotating wheel and the track will rapidly cause the wheel to wear into a noncircular configuration.

Attempts to move a noncircular wheel along a track is likely to cause major damage to sections of the track and related equipment adjacent thereto. For example, the switch points and other crossovers are specifically designed to accomodate the rolling movement of a nearly perfectly round wheel. The sliding movement of a noncircular object into these switch points can cause significant structural damage which can be attributable to subsequent derailments. The probability of damage resulting from the impact of the noncircular wheels to a switch point or the like can be appreciated when it is considered that a railway vehicle may weigh more than forty tons, and the vehicle may be traveling fifty miles per hour. Noncircular wheels also can damage structural or electrical equipment adjacent to the rail. For example, as the wheel assumes a noncircular configuration, the degree to which the flange of the wheel extends below the top riding surface of the rail increases. In extreme instances, the flange of a noncircular wheel will contact and break an adjacent structure.

A railway vehicle typically is mounted on a pair of separate trucks. Each truck generally includes a unitary frame onto which two axles and two pairs of wheels are mounted. Each axle and its associated wheels typically defines an integral structure that can not readily be disassembled into its parts. Consequently a broken or disabled wheel can not be removed and replaced by a spare, as might be done with an automobile.

In the past, the movement of vehicles with broken or non-rotating wheels has involved the placement of the wheels into a non-rotating position and the subsequent dragging of the disabled vehicle along the track. The disabled wheels have been placed in a non-rotating position either by welding the wheel to a fixed member or by cutting holes in opposite wheels and extending a locking bar therethrough. As noted above, this cutting and welding is known to present a significant safety hazard in many railway system environments. After the wheels have been suitably locked into a non-rotating position, the entire portion of track intermediate the point of disability and the repair shop is lubricated to facilitate the non-rotating movement of the disabled wheels, and to reduce the chance of damage to special work such as switch points. This lubrication of the tracks has been a slow labor intensive task. In many instances the section of track to be lubricated would extend twenty or more miles. Furthermore, to insure the safe stopping of trains that follow the disabled train it has been necessary to either sand the lubricated tracks or otherwise remove the lubrication. This also has been extremely time consuming and labor intensive.

Attempts to develop improved equipment and procedures for removing disabled vehicles have not been particularly successful, especially in the older urban systems where disabilities are most prevalent. Specifically, in these older systems the clearances in many tunnels, trestles and bridges may be no more than a few inches. Consequently the possibility of using additional equipment had long been thought of as being unavailable.

In view of the above, it is an object of the subject invention to provide an apparatus for facilitating the removal of disabled railway vehicles.

It is another object of the subject invention to provide an apparatus that can quickly be mounted to the disabled vehicle to minimize disruption to the railway system.

It is an additional object of the subject invention to provide an apparatus that can be employed to move a disabled railway vehicle along closely confined sections of track.

It is a further object of the subject invention to provide an apparatus for moving a disabled railway vehicle that does not require the use of welding or cutting equipment for proper installation.

It is still another object of the subject invention to provide an apparatus for moving a disabled railway vehicle that can be adapted to a wide range of vehicle types.

SUMMARY OF THE INVENTION

The subject invention is directed to an apparatus including a pair of transfer wheels which can be mounted to a disabled railway vehicle. More particularly the apparatus includes a pair of transfer wheels each of which is rotatably mounted in a support frame. The support frames are securely mounted to opposed ends of spreader bar which maintains the proper distance between the support frames for insuring the desired rolling engagement of each transfer wheel with its respective line of rails.

The transfer wheels of the subject transfer wheel assembly are of the same general configuration as other railway wheels. More particularly the transfer wheel is formed from a metallic material and includes an annular flange extending entirely around one side. The transfer wheels are positioned such that the flanges are disposed on the inside of the respective line of rails, as is the customary practice with all railway wheels. Preferably the transfer wheels of the subject invention are formed from a cast metal, such as cast steel. Additionally, in the preferred embodiment described further below, the transfer wheels are of a significantly smaller diameter than the principal wheels of the railway vehicle to facilitate the transportation and mounting of the subject transfer wheel assembly.

Each support frame of the transfer wheel assembly includes a pair of axle boxes in which the respective transfer wheel is rotatably mounted. Each support frame further includes a yoke to which the axle boxes are mounted. The yoke includes a generally inverted U-shaped portion including a pair of upstanding legs extending generally parallel to one another and generally perpendicular to the axis of the transfer wheel. The upstanding legs are connected at their uppermost portion by a top flange. The lower end of each leg terminates in a bottom flange. The top and bottom flanges are generally parallel to one another and generally parallel to the axis of the transfer wheel. The axle boxes are securely mounted respectively to the two bottom flanges such that the transfer wheel is rotatably mounted between the legs of the corresponding support frame.

A pair of mounting posts extend from the top flange of each yoke. The mounting posts are generally parallel to one another and parallel to the legs of each yoke. Each mounting post is characterized by at least one aperture extending through the end thereof most distant from the yoke. The apertures in the mounting posts are aligned with one another such that a bolt may be extended through two apertures to enable the mounting of the subject support frame to the railway vehicle as explained herein.

Each support frame further is provided with a means for mounting a bracket. The function of the bracket is to keep the subject transfer wheel assembly in the proper plane for supporting the railway vehicle, and to prevent rotation of the transfer wheel assembly about the bolts extending through the mounting posts. Preferably the means for mounting the bracket is disposed at a location on the respective support frame spaced from the apertures in the mounting posts. Furthermore, the means for mounting the bracket should be in a location that is readily accessible to a person working on a disabled vehicle. For example, in a preferred embodiment described further below, the means for mounting the bracket is disposed in the outside leg of each support frame. More particularly the means for mounting the bracket is defined by an aperture extending through the outside leg of the yoke of the preferred embodiment described herein. A bolt then extends through the aperture in the outside leg and is securely but releasably attached to the bracket. The bracket extends from the support frame to an appropriate location on the truck of the disabled railway vehicle. The specific location on the truck will vary depending upon the specific characteristics of the truck. However, it is preferred that the location to which the bracket is mounted be readily accessible, yet not subject to contacting structures adjacent to the track.

The subject transfer wheel assembly is employed by first utilizing wedges or clamps to temporarily lock the suspension system of the truck into the condition it is in when supporting the weight of the railway vehicle. The disabled truck and the railway vehicle supported thereon then are jacked upwardly away from the rails so that the broken, flattened, non-rotating or otherwise disabled wheel is lifted off the bearing surface of the rail. The amount of lift required to remove the disabled wheel from the rail is minimized by wedging or clamping the suspension system of the truck in the manner described above. The transfer wheel assembly of the subject invention then is mounted to the truck. The specific mounting will vary according to the design of the truck. Generally however the mounting posts will first be pivotally mounted to an appropriate location at an upper portion of the truck. The bracket then would be mounted to the bracket mounting means on the respective support frame and further would be mounted to the appropriate location on the truck to prevent pivoting of the transfer wheel assembly about the mounting posts. The jacks then are lowered such that a portion of the weight of the railway vehicle is supported on the transfer wheels.

As explained in greater detail below, on certain railway vehicles, the brakes attached to the disabled wheels can be removed, and the mounting posts can be mounted in their place. On other railway vehicles, on the other hand, it may first be necessary to bolt or otherwise temporarily attach a structure to the truck to which the mounting posts then are mounted. Additionally, as described herein, in many instances the brackets of each of the two support frames on the transfer wheel assembly will differ from one another, reflecting the fact that the right and left sides of the truck are structurally different. In this respect, it is noted that ease and security of mounting are the prime considerations of the design.

DETAILED DESCRIPTION OF THE PREFERRED EMBODIMENTS

Figure 1:
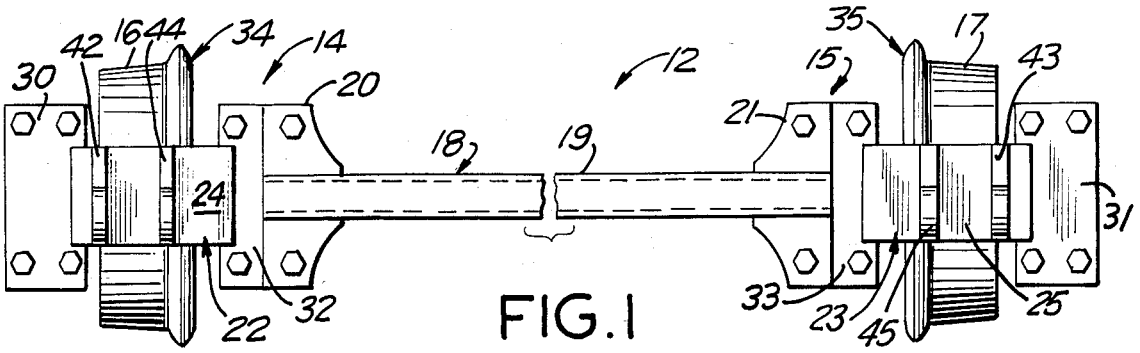
FIG. 1 is a plan view of the transfer wheel assembly of the subject invention.
Figure 2:
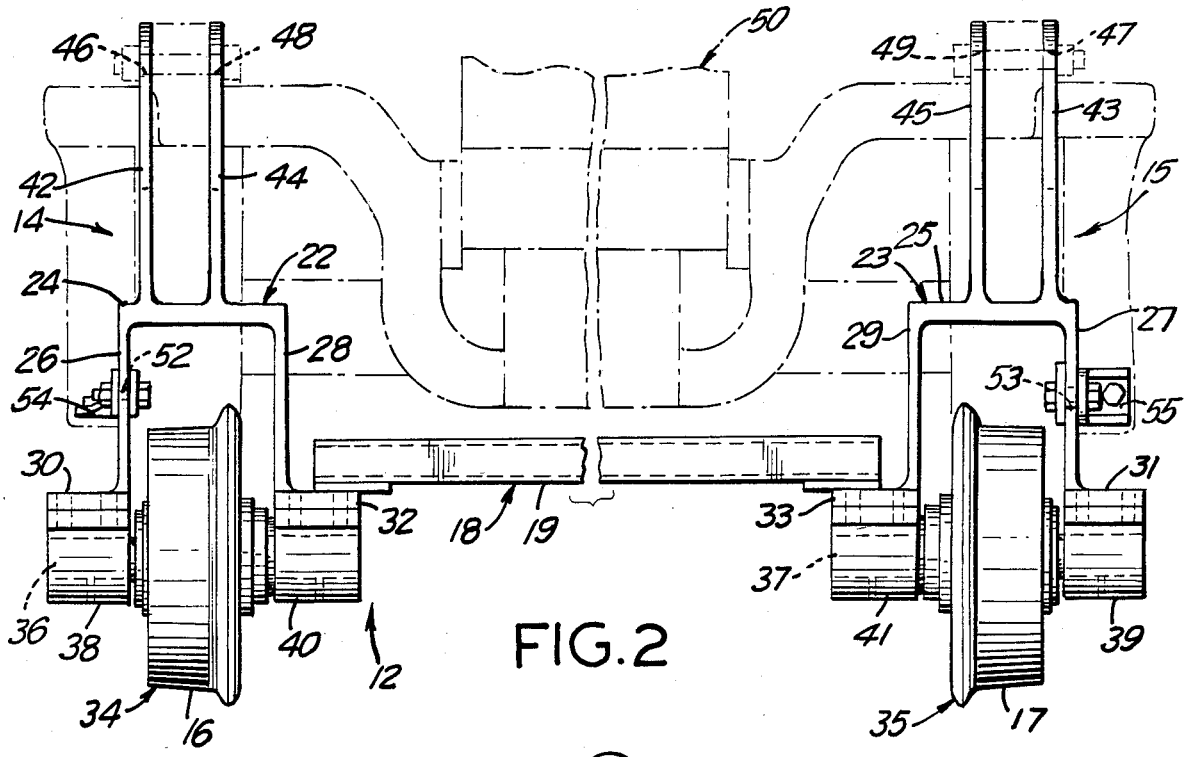
FIG. 2 is a front view of the assembly shown in FIG. 1.
Figure 3:
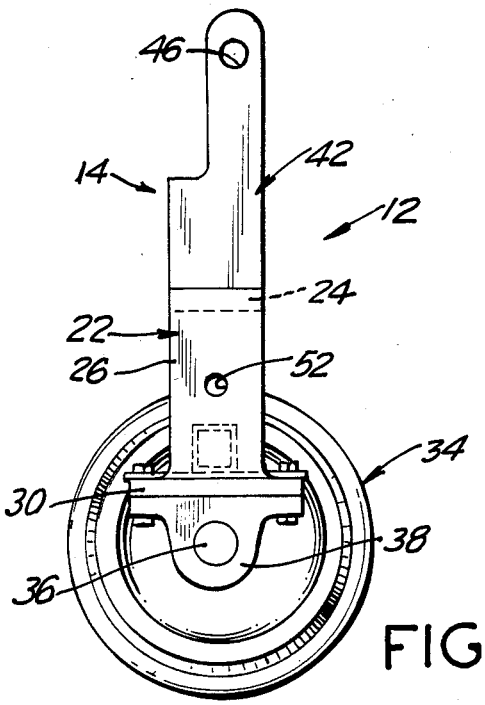
FIG. 3 is a side view of the assembly shown in FIG. 1.

The transfer wheel assembly of the subject invention is indicated generally by the numeral 12 in FIGS. 1 through 3. The transfer wheel assembly 12 includes first and second support frames 14 and 15 respectively, in which transfer wheels 16 and 17 respectively are mounted. The support frames 14 and 15 are connected to one another by spreader bar 18 which insures that the spacing between transfer wheels 16 and 17 remains constant and appropriate for properly mounting the transfer wheels 16 and 17 on a pair of rails (not shown). The spreader bar assembly 18 is formed from a 2.5 inch square steel tubing 19 having ⅜ inch steel mounting plates 20 and 21 welded to opposed ends of the tubing 19. The mounting plates each are provided with means for mounting to the support frames 14 and 15 as explained further below.

The first and second support frames 14 and 15 include yokes 22 and 23 respectively. Yoke 22 includes a top flange 24, outer and inner legs 26 and 28, an outer and inner bottom flanges 30 and 32 respectively. Similarly, the yoke 23 of the second support frame 15 includes a top flange 25, outer and inner legs 27 and 29 and outer and inner bottom flanges 31 and 33. The yokes 24 and 25 can be formed from a unitary steel member. Alternatively, the yokes 24 and 25 can be fabricated from sections of a wide-flange (WF) steel beam. With reference to yoke 24, the legs 26 and 28 can represent the web portions of two sections of a WF beam. Two flanges of each beam section can be removed to create two Z-shaped members. Two of the remaining flange members can be welded together to form the top flange 24 shown in FIG. 2. The remaining two flanges are disposed to extend away from one another and to define the bottom flanges 30 and 32 shown most clearly in FIG. 2.

Stub wheel assemblies 34 and 35 are mounted respectively to the yokes 22 and 23. More particularly the stub wheel assembly 34 includes the fourteen inch transfer wheel 16 identified above. The transfer wheel 16 is mounted on axle 36 which in turn is rotatably mounted in axle blocks 38 and 40. The axle blocks in turn are securely mounted to the bottom flanges 30 and 32 respectively of the yoke 22.

In a similar manner, the stub wheel assembly 35 is mounted to the right support frame 15. More particularly the fourteen inch stub wheel 17 identified above is fixedly mounted on axle 37 which in turn is rotatably mounted in axle blocks 39 and 41. The axle blocks are securely affixed to the bottom flanges 31 and 33 of the yoke 23.

Vertical support posts 42 and 44 extend generally perpendicularly from the top flange 24 of the yoke 22. The vertical support posts 42 and 44 preferably are formed from ¾ inch thick flat steel bars which at their base are approximately four inches wide. The vertical posts 42 and 44 include apertures 46 and 48 at the ends thereof most distant from the yoke 22. More particularly the apertures 46 and 48 are aligned with one another to enable secure mounting on the truck 50 of a disabled railway vehicle. In a similar manner vertical support posts 43 and 45 extend from the top flange 25 of yoke 23. The vertical support posts 43 and 45 are provided with aligned apertures 47 and 49. The vertical support posts 42, 43, 44 and 45 are welded securely to their respective yokes 22 and 23. As shown most clearly in FIG. 3, the upper portion of the vertical support posts 42, 43, 44 and 45 is narrower than the lower portions thereof. This narrower width facilitates a proper mounting of the transfer wheel assembly 12 to certain trucks 50 as explained further below.

The support frames 14 and 15 each are provided with a means for mounting a bracket, which in turn can be mounted to the truck 50 of a disabled railway vehicle. This bracket prevents rotational movement of the transfer wheel 12 with respect to the truck 50. More particularly, and as shown most clearly in FIGS. 2 and 3, in the preferred embodiment the means for mounting the bracket are apertures 52 and 53 which extend through the outside legs 26 and 27 of yokes 22 and 23 respectively. Brackets 54 and 55 are provided to be mounted to the apertures 52 and 53 respectively. As explained further below, the brackets 54 and 55 are further adapted to be attached to the truck 50, thereby preventing rotation of the entire transfer wheel assembly 12 about the connections of the vertical posts 42–45 to the truck 50. By locating the apertures 52 and 53 on the outside legs 26 and 27 respectively, the mounting of the brackets 54 and 55 is accessible to the worker and can be accomplished relatively easily.

Figure 4:
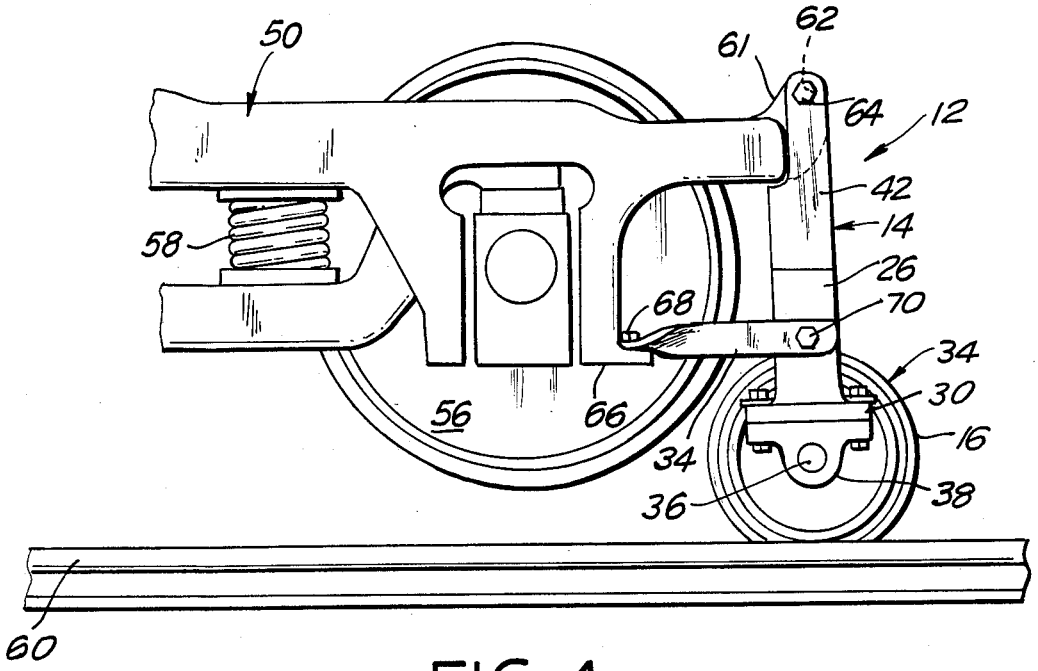
FIG. 4 is a side view of the transfer wheel assembly of the subject invention mounted on a disabled railway vehicle.
Figure 6:
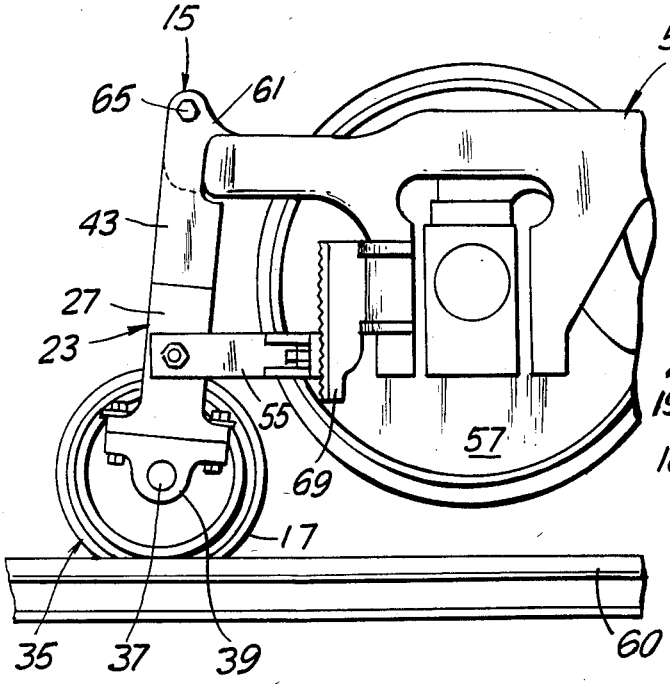
FIG. 6 is a side view of the transfer wheel assembly and disabled vehicle shown in FIG. 5.
Figure 5:
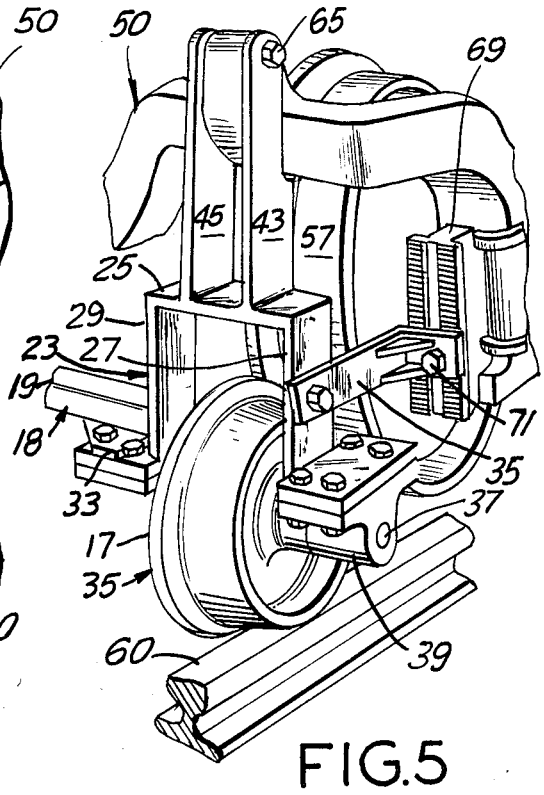
FIG. 5 is a perspective view of the transfer wheel assembly of the subject invention mounted on the side of a disabled railway vehicle opposite the side shown in FIG. 4.

Turning to FIGS. 4 through 6, the transfer wheel assembly 12 is shown mounted on the truck 50 of a disabled railway vehicle. The truck 50 includes a plurality of wheels, such as wheels 56 and 57, which for some reason (e.g. locked pinion or fracture) are inoperable. The truck 50 includes a plurality of spring members 58 which are part of the suspension system of the railway vehicle. One of the first steps undertaken by the railway worker assigned to move the disabled vehicle is to lock the spring means 58 in their compressed, weight bearing position. This assures that a small amount of jacking of the vehicle will enable the disabled wheel 56 to be lifted from the rail 60 as shown in FIGS. 4 through 6.

On the truck 50 shown in FIGS. 4 through 6, a brake mounting bracket 61 is provided adjacent each wheel 56 or 57. The brake mounting bracket includes an aperture 62 which is adapted to recieve a dead lever pin (not shown). A dead lever brake shoe assembly is pivotally mounted to the bracket about the dead lever pin, and under normal operating conditions is adapted to rotate into frictional engagement with the outer circumference of the wheel 56 or 57. This frictional engagement of the brake shoe and the wheel 56 and 57 stops the rotational movement of the wheels 56 and 57, and thereby brings the vehicle to a halt. On the disabled vehicle, the brake shoes associated with the inoperative wheels are not needed, since the wheel will be lifted several inches from the track. Therefore the railway worker removes the dead lever pin and the brake shoe assembly pivotally attached thereto. This is a simple operation on most railway vehicles, since the brake shoes are checked and replaced on a frequent basis as part of normal maintenance.

While the appropriate brake shoe assemblies are being removed from the truck 50, jacks are positioned to lift the disabled vehicle from the track. Typically two sixty-two pound jacks each capable of lifting thirty tons are used for this purpose. However inflatable air bags also may be employed, with the specific jacking method depending on the nature of the disability and the available space. Typically the jacking of the vehicle is sufficient to lift the disabled wheels about two inches off the rail. It should be noted that each truck 50 typically will mount four wheels. In many instances only two of these four wheels will be disabled. Thus, the blocking of the suspension system and the jacking is carried out such that the two operable wheels remain in contact with the rails 60 while only the disabled wheels are lifted therefrom. If, on the other hand, all four wheels are disabled, the entire truck 50 can be appropriately jacked and blocked, and two transfer wheel assemblies 12 can be employed as described herein.

After the wheels 56 have been appropriately elevated from the rail 60 the transfer wheel assembly 12 is rolled into position adjacent the elevated wheels 56. More particularly the transfer wheel assembly 12 is positioned such that the apertures 46–49 in the vertical support posts 42–45 respectively are aligned with the apertures 62 in the brackets 61 on truck 50. A dead lever bolt 64 then is passed through the apertures 46, 48 and 62 to pivotally mount the support frame 14 to the truck. Similarly a bolt 65 is passed through apertures 47, 49 and 62 to pivotally mount the support frame 15 to the opposed side of truck 50. As shown most clearly in FIGS. 4 and 6, the narrower width of each vertical post 42–45 adjacent the tops thereof enables the transfer wheel assembly 12 to be mounted in a plane more closely approaching the vertical.

To enable the transfer wheel assembly 12 to remain in an angular position where it can support a portion of the disabled vehicle, it is next necessary to mount brackets 54 and 55 between the transfer wheel assembly 12 and the truck 50. More particularly, the bracket 54 extends from the outer leg 26 of the support frame 14 to the tie plate pedestal 66 of the truck 50. The tie plate pedestal 66 is the portion of the truck 50 to which the journal box supporting wheel 56 is secured. The bracket 54 is secured to the tie plate pedestal 66 by removing one of the bolts through the tie plate pedestal 66 and extending an alternate bolt 68 through both the bracket 54 and the tie plate pedestal 66. The opposed end of bracket 54 is mounted to the leg 26 of support frame 14 by bolt 70. As shown clearly in FIG. 4, the bracket 54 effectively prevents rotation of support frame 14 about bolt 64 at the upper end vertical support posts 42 and 44.

Turning to FIGS. 5 and 6, bracket 55 is provided to prevent the second support frame 15 from rotating about pin 65. More particularly, the bracket 55 is shown as extending from the leg 27 to the washboard-like surface of the hydraulic tripper 69. The hydraulic tripper is provided on many railway vehicles to trigger the automatic engagement of the brakes when, for example, the vehicle improperly passes through a stop signal. The connection of bracket 55 to the hydraulic tripper 69 is made by first disconnecting the hydraulic hose (not shown) which normally would be attached adjacent the hydraulic tripper 69. A bolt 71 is mounted through bracket 55 and attached to the hydraulic tripper 69. Thus, the bracket 55 effectively prevents rotation of the second support frame 15.

In this fully mounted position, the transfer wheel assembly 12 is positioned to support a portion of the weight of the disabled railway vehicle with the disabled wheels 56 and 57 elevated from the rail 60 approximately two to four inches.

Figure 7:
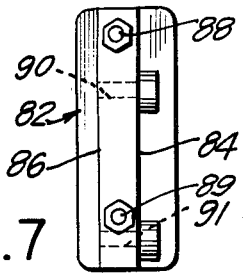
FIG. 7 is a front view of an adaptor for use with the assembly of the subject invention.
Figure 8:
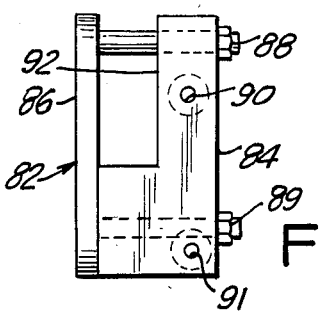
FIG. 8 is a side view of the adaptor shown in FIG. 7.

Turning to FIGS. 7 through 11, an alternate embodiment of the subject invention is illustrated. More particularly, on certain trucks, such as truck 80 shown in FIGS. 9 through 11, there is no bracket comparable to bracket 61 illustrated in FIGS. 4 through 6 above. Rather, the brake shoes are mounted elsewhere on the truck 80. As a result, an adaptor clamp 82 as illustrated in FIGS. 7 and 8 is provided to mount the transfer wheel assembly 12. The adaptor clamp 82 is adapted to be mounted on truck 80 such that the subject transfer wheel assembly 12 can be mounted to the adaptor clamp 82 as explained herein.

The adaptor clamp 82 includes a generally L-shaped support bracket 84 and a clamping plate 86. The clamping plate 86 is attached to the support bracket 84 by bolts 88 and 89. The support frame 84 further is provided with a pair of apertures 90 and 91 which are generally perpendicular to the bolts 88 and 89. By this configuration, the clamping plate 86 can be secured to the support bracket 84 to define a mounting slot 92 therebetween.

Figure 9:
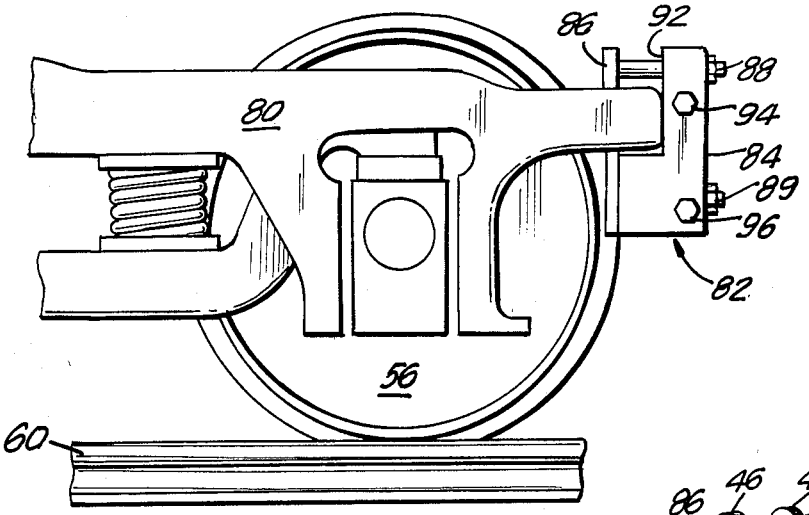
FIG. 9 is a side view of the adaptor of FIGS. 7 and 8 mounted on the truck of a railway vehicle.
Figure 11:
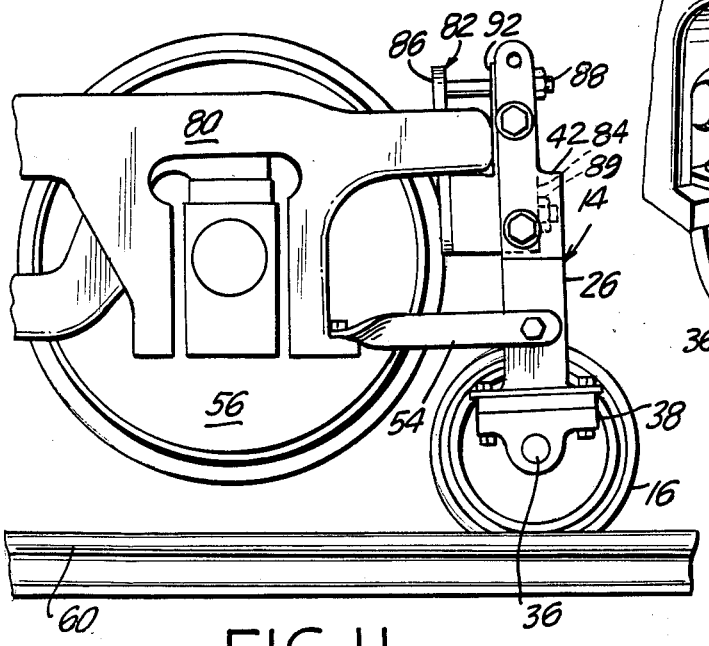
FIG. 11 is a side view of the adaptor and transfer wheel assembly shown in FIG. 10.
Figure 10:
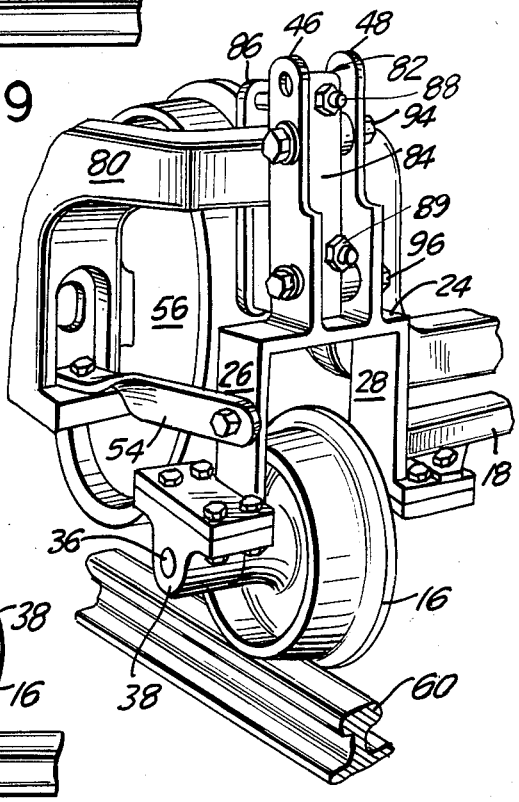
FIG. 10 is a perspective view of the transfer wheel assembly of the subject invention used with the adaptor of FIGS. 7 and 8.

As illustrated most clearly in FIGS. 9 through 11, the bolt 88 is removed from the adaptor clamp 82 and the adaptor clamp 82 then is mounted to the truck 80 such that the mounting slot 92 engages a convenient support point on truck 80. Preferably, as illustrated in the figures, the adaptor clamp 82 is mounted to a portion of the frame of truck 80 which extends between the wheels of the truck 80. After the mounting slot 92 of the adaptor clamp 82 is properly positioned with respect to the truck 80, the bolt 88 is replaced to securely engage the adaptor clamp 82 with truck 80. The transfer wheel assembly 12 then is mounted to the adaptor clamp 82 in substantially the same manner as explained above. More particularly the vertical support posts 46 and 48 are mounted to the support bracket 84 by bolts 94 and 96. The bolts 94 and 96 extend through apertures in the vertical posts 46 and 48 and further extend through the apertures 90 and 92 in the support bracket 84.

In either of the above described embodiments, the transfer wheel assembly 12 can be quickly and easily mounted to the truck of the disabled vehicle to enable the vehicle to be transported to a location where proper repair work can be performed. The mounting of the transfer wheel assembly does not require expensive training and can be mounted easily within the close confines of many railway tracks. Furthermore, the assembly can be manufactured from readily available materials.

In summary a transfer wheel assembly is provided for mounting on a disabled railway vehicle to enable the prompt removal of the vehicle to a location where repair work can properly be performed. The assembly includes a pair of transfer wheels mounted to their respective support frames. The support frames are connected by a spreader bar which maintains the proper spacing between the two transfer wheels. The support frame can be mounted to the truck of a disabled railway vehicle. Preferably the mounting is at a plurality of locations on each side of the vehicle to maintain the transfer wheel assembly in a proper plane for supporting the weight of the vehicle.

While the invention has been described and illustrated with respect to certain preferred embodiments, it is obvious that various modifications can be made therein without departing from the spirit of the present invention which should be limited only by the scope of the appended claims.

What is claimed is:

1. A transfer wheel assembly for rapid, temporary and removable mounting to the truck of a disabled railway vehicle to enable movement thereof, said assembly comprising:

a pair of generally U-shaped yokes each having parallel inner and outer legs, a top flange connected to and extending between said legs and a pair of bottom flanges connected to said legs respectively at the ends thereof opposite said top flange, said bottom flanges extending away from one another generally parallel to said top flange;

first and second axle blocks securely mounted respectively to each said bottom flange;

a pair of transfer wheels rotatably mounted respectively in the axle blocks of each said yoke;

a spreader bar rigidly attached to and extending between the respective inner legs of said yokes to keep the transfer wheels in fixed spaced relationship to one another;

a pair of spaced apart parallel support posts connected to and extending from said top flange of each said yoke, each said support post including at least one aperture extending therethrough said aperture being adapted to receive a bolt for mounting said assembly to first locations on said truck;

a pair of brackets removably mounted respectively to the outer leg of each said yoke, said bracket being adapted to be removably mounted to second locations on said truck.

2. A transfer wheel assembly as in claim 1 wherein said support posts each are mountable to said truck at one location.

3. A transfer wheel assembly as in claim 1 further including a pair of adaptor clamps, said adaptor clamps being mountable to the truck of said railway vehicle, each said adaptor clamp including means for mounting one said pair of support posts to said adaptor clamp.

4. A transfer wheel assembly as in claim 3 wherein each said adaptor clamp includes a generally L-shaped base and a generally planar clamping plate removably attached to said base so as to define a mounting slot therebetween, said mounting slot being dimensioned to engage a portion of said truck, said base further including means for mounting the support post thereto.

5. A transfer wheel assembly as in claim 4 wherein the base of each said adaptor clamp is dimensioned to fit intermediate said support posts, said base and said support posts each being provided with a pair of aligned apertures extending therethrough, said transfer wheel assembly further including a plurality of dead lever bolts, said dead lever bolts being dimensioned to be passed through the apertures in said support posts and said bases to removably mount said support posts to said adaptor clamps.

6. A transfer wheel assembly as in claim 1 wherein each said yoke is formed from a pair of segments of a wide flange beam securely attached to one another.

7. A transfer wheel assembly as in claim 1 wherein said spreader bar is formed from square steel tubing having a width of approximately 2.5 inches.

8. A transfer wheel assembly as in claim 1 wherein each said support post includes a narrow portion at the end thereof opposite said yoke.

9. A transfer wheel assembly as in claim 1 wherein the truck includes a plurality of brake mounting apertures, said support posts being pivotaly mounted to said truck at said brake mounting apertures thereof.

* * * * *